US008672325B2

(12) United States Patent
Green

(10) Patent No.: US 8,672,325 B2
(45) Date of Patent: Mar. 18, 2014

(54) INSTANT WIN GAMING TICKET AND METHOD

(75) Inventor: Philip Warren Green, Valrico, FL (US)

(73) Assignee: GTech Printing Corporation, Providence, RI (US)

( * ) Notice: Subject to any disclaimer, the term of this patent is extended or adjusted under 35 U.S.C. 154(b) by 447 days.

(21) Appl. No.: 11/281,070

(22) Filed: Nov. 17, 2005

(65) Prior Publication Data

US 2006/0066043 A1 Mar. 30, 2006

Related U.S. Application Data

(62) Division of application No. 10/108,308, filed on Mar. 27, 2002, now abandoned.

(51) Int. Cl.
*A63B 71/00* (2006.01)

(52) U.S. Cl.
USPC ..... 273/138.1

(58) Field of Classification Search
None
See application file for complete search history.

(56) References Cited

U.S. PATENT DOCUMENTS

| | | | | | |
|---|---|---|---|---|---|
| 4,582,324 | A * | 4/1986 | Koza et al. | 463/16 |
| 4,652,998 | A * | 3/1987 | Koza et al. | 463/26 |
| 5,129,652 | A * | 7/1992 | Wilkinson | 273/139 |
| 5,158,293 | A * | 10/1992 | Mullins | 273/139 |
| 5,286,062 | A * | 2/1994 | Greenwood et al. | 283/106 |
| 5,887,906 | A | 3/1999 | Sultan | |
| 5,949,042 | A * | 9/1999 | Dietz et al. | 235/375 |
| 5,980,385 | A * | 11/1999 | Clapper, Jr. | 463/17 |
| 6,145,835 | A | 11/2000 | Such | |
| 6,210,276 | B1 | 4/2001 | Mullins | |
| 6,220,961 | B1 | 4/2001 | Keane et al. | |
| 6,224,055 | B1 * | 5/2001 | Walker et al. | 273/139 |
| 6,250,685 | B1 * | 6/2001 | Walker et al. | 283/49 |
| 6,276,683 | B1 | 8/2001 | Such | |
| 6,293,424 | B1 * | 9/2001 | Love | 221/4 |
| 6,325,716 | B1 * | 12/2001 | Walker et al. | 463/17 |
| 6,491,297 | B1 * | 12/2002 | Cardoso | 273/138.1 |
| 6,527,175 | B1 * | 3/2003 | Dietz et al. | 235/381 |
| 6,588,747 | B1 * | 7/2003 | Seelig | 273/138.1 |

(Continued)

FOREIGN PATENT DOCUMENTS

| | | |
|---|---|---|
| CA | 2194515 | 7/1998 |
| GB | 2318985 A | 5/1998 |
| WO | WO 01/42968 A1 | 6/2001 |
| WO | WO 01/93966 | 12/2001 |
| WO | WO 02/02198 | 1/2002 |

OTHER PUBLICATIONS

"All New Bingo," http://www.state.nj.us/lottery/instant/allnewbingo.htm, 2 pgs., (Copyright © State of New Jersey, 2004) (Printed Apr. 12, 2005).

(Continued)

*Primary Examiner* — Kurt Fernstrom
*Assistant Examiner* — Dolores Collins
(74) *Attorney, Agent, or Firm* — Sullivan & Worcester LLP; Christopher T. McWhinney

(57) ABSTRACT

Methods and apparatus for playing an instant win gaming ticket. An instant win gaming ticket has multiple instant win games which can be played by the player. The amount won per game is dependent on the results of at least one previous game on the same ticket. The player plays the games on a single ticket and the amount the player wins for each game depends on whether previously played games on the same ticket were won or lost.

27 Claims, 5 Drawing Sheets

(56) References Cited

U.S. PATENT DOCUMENTS

| | | | | |
|---|---|---|---|---|
| 6,616,531 | B1 * | 9/2003 | Mullins | 463/19 |
| 8,333,380 | B2 * | 12/2012 | Berkowitz | 273/139 |
| 2001/0019193 | A1 | 9/2001 | Gumina | |
| 2002/0145039 | A1 | 10/2002 | Carroll | |
| 2003/0060262 | A1 | 3/2003 | Yeend | |
| 2003/0184012 | A1 * | 10/2003 | Green | 273/139 |
| 2004/0162131 | A1 * | 8/2004 | Shuster | 463/17 |
| 2005/0250573 | A1 * | 11/2005 | Kane et al. | 463/17 |
| 2006/0189373 | A1 * | 8/2006 | Shuster | 463/17 |
| 2007/0077983 | A1 * | 4/2007 | Amada et al. | 463/17 |
| 2007/0259719 | A1 * | 11/2007 | Kane et al. | 463/43 |

OTHER PUBLICATIONS

"Instant Games List—2001," http://www.state.nj.us/lottery/instant/2-5_games_list_01.htm, 3 pgs., (Copyright © State of New Jersey, 2004) (Printed Apr. 12, 2005).

CT Lottery—pp. 1-64 of sample tickets.

Kansas Lottery—p. 1 of sample tickets.

New Jersey Lottery—p. 1 of sample tickets.

New Hampshire Lottery—pp. 1-69 of sample tickets.

Snow Bank doubler—Maryland Lottery.

* cited by examiner

INSTANT WIN GAMING TICKET AND METHOD

FIELD OF THE INVENTION

The present invention relates to games and is especially but not exclusively applicable to methods and devices for playing instant win gaming tickets.

BACKGROUND TO THE INVENTION

Lottery games, and especially instant win lottery gaming tickets also known as scratch off lottery tickets, have had a resurgence in popularity in recent years. Their popularity stems from the instant gratification they provide to players. Players instantly know whether they have won or not and there is no need to wait for results as in weekly or bi-weekly lotteries. Also, instant lottery games require more active involvement from the player than the weekly lotteries. Thus, instant lottery games provide more entertainment value to players than other, more regular lotteries.

One method of providing entertainment to instant lottery game players is by having instant lottery games attempt to replicate the thrill of playing the more traditional wagering games such as blackjack, roulette, slots, and other similar games. However, one aspect that instant win gaming tickets have not been able to replicate is the wagering aspect of such traditional games. Currently, players only win set amounts for each instant win game they play. For some instant win gaming tickets, there could be multiple games per ticket. Thus, regardless of how many independent games may be played on a single ticket, a player's maximum possible prize is set—a player does not increase his potential winnings by winning more games. The player is not given the chance to wager more for each game and, consequently, his chances of winning a larger prize is not increased. "Streaks" of luck or consecutive games won are not rewarded.

This feature of being able to wager more on an instant win game would, if available, entice more players to play the instant win gaming tickets. Furthermore, such an enhancement would increase the entertainment value of the games for the players.

From the above, there is therefore a need for a gaming system or an instant win gaming ticket that provides the required enhancement. It should be noted that instant lottery games are a subset of instant win gaming tickets. Such instant win gaming tickets encompass all types of gaming that involve pre-printed tickets that players play by revealing the pre-printed results. As noted above, one possible type of such tickets are those commonly known as "scratch-off" or "scratch and win" lottery tickets.

An object of the present invention is to overcome, or at least mitigate, one or more drawbacks of the prior art, or at least provide an alternative.

SUMMARY OF THE INVENTION

The present invention seeks to provide methods and apparatus for playing an instant win gaming ticket. An instant win gaming ticket has multiple instant win games which can be played by the player. The amount won per game is dependent on the results of at least one previous game on the same ticket. The player plays the games on a single ticket and the amount the player wins for each game depends on whether previously played games on the same ticket were won or lost.

In a first aspect, the present invention provides an instant win gaming ticket having indicia defining at least two instant win games, a first one of the at least two instant win games having associated therewith a predetermined prize for a win result wherein a distinct prize for at least one of the at least two instant win games other than the first one is determined based on a result of at least one other instant win game on the ticket.

In a second aspect, the present invention provides a method of allocating prizes for playing a plurality of games, the method comprising increasing prize amounts awarded after every game played based on a number of games won.

Preferably, prize amounts awarded after every game played is based on a number of consecutive games won.

BRIEF DESCRIPTION OF THE DRAWINGS

A better understanding of the invention will be obtained by considering the detailed description below, with reference to the following drawings in which.

DETAILED DESCRIPTION

Figure 1:
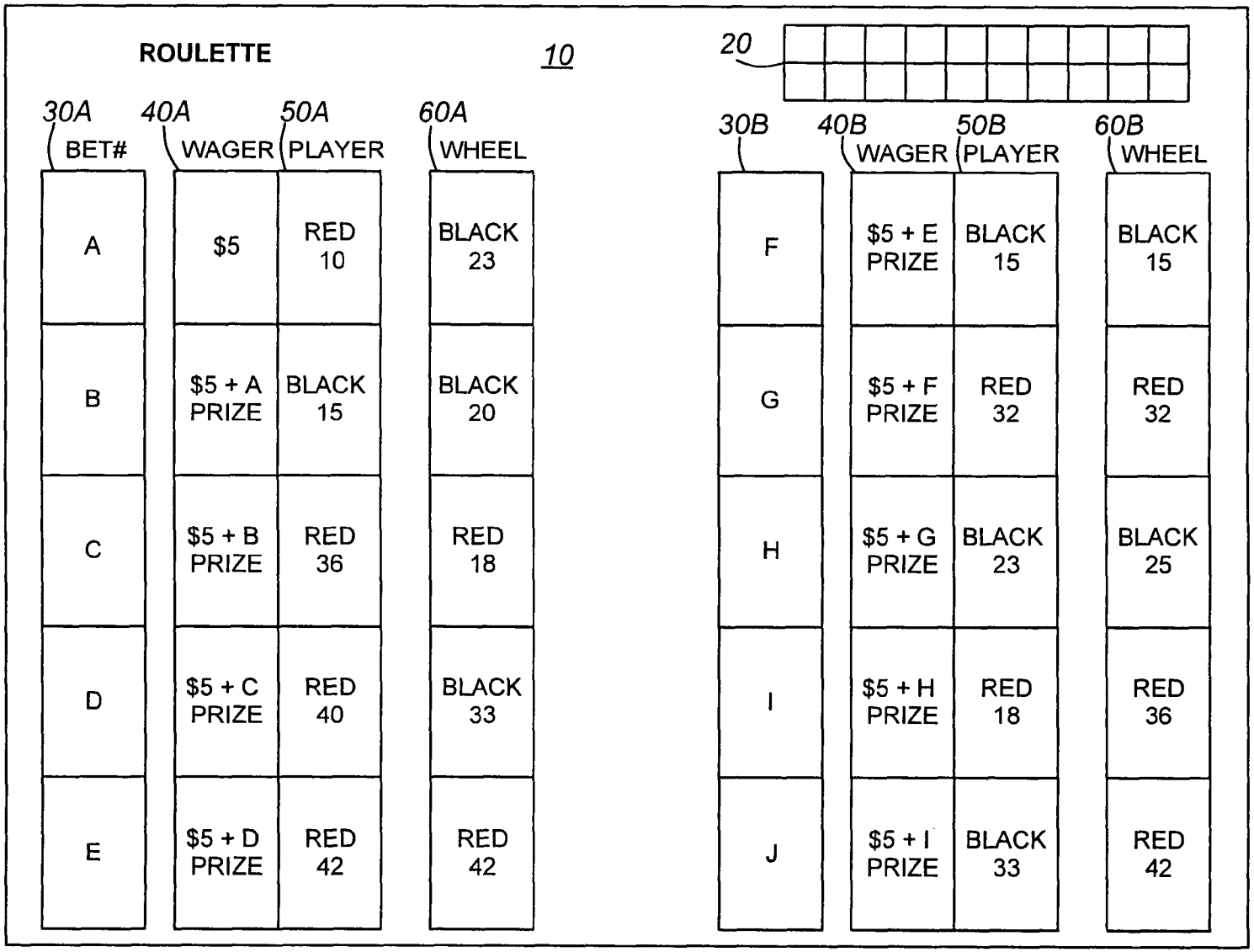
FIG. 1 illustrates an instant win gaming ticket using a system according to one embodiment of the invention.

Referring to FIG. 1, an instant win gaming ticket 10 is illustrated. The ticket 10 has a win table 20, betting number columns 30A, 30B, a wager column 40A, 40B, player's result columns 50A, 50B, and dealer/house result columns 60A, 60B.

The win table 20 indicates the possible prizes or prize amounts if a given set of conditions are fulfilled by the results of the games on the ticket 10. The betting number columns 30A, 30B serve as reference points by which the player can track the games being played. The wager columns 40A, 40B indicate the amounts being wagered for each game and, concomitantly, the distinct or specific possible prize identifiable with each game. The player's result columns 50A, 50B indicate the game result for the player. This result is to be compared to the entry in the dealer/house result columns 60A, 60B to determine if the player has won a particular game.

It should be noted that similar instant win gaming tickets are generally pre-printed with the results covered. Players purchase or otherwise obtain the tickets not knowing the results and sequentially uncover the results to determine if their gaming ticket has won a prize or not.

Initially, columns 50A, 50B, 60A, 60B are covered prior to a player purchasing or obtaining the ticket. These columns may be uncovered in any sequence but preferably sequentially to effectively play the games. The ticket is divided into three areas—one area for the first set of games (columns 30A, 40A, 50A, 60A), a second area for a second set of games (columns 30B, 40B, 50B, 60B), and a third area for the win table 20. As can be seen in FIG. 1, each row in a particular area denotes a single game. For the ticket illustrated in FIG. 1, the single game type to be played is a simulation of the well-known game of roulette. The object is for the player result (as shown in columns 50A, 50B) to match the wheel result (as shown in columns 60A, 60B).

It can be seen from the ticket in FIG. 1 that the player has not won for bet/game A—the player result is Red 10 while the wheel result is Black 23. It can also be seen that the player has a similar losing result for bets/games B, C, and D. However, for bet/game E, the player result is the same as the wheel result. This therefore means that the player has won this particular game. Similarly, for bets/games F and G, the player's results match the wheel results. As such, the player has won 3 games in a row or 3 consecutive games have been won. Because of these consecutive wins, the player thus wins more than what he would have won had he only won three non-consecutive games.

The player's distinct prize identifiable with a specific game is dependent on the wager. Since game E had a wager of $5+D prize, and since the prize for game D is zero (due to the player losing game D), then the wager for game E is $5. Assuming that the ticket pays double the wager for every game won, then the prize for winning game E is $$\begin{aligned}\text{Prize for game } E &= (\text{wager for game } E)\times 2\\ &= (\$5 + D \text{ prize})\times 2\\ &= (\$5+0)\times 2\\ &= \$5\times 2\\ &= \$10\end{aligned}$$

The prize for winning game F is therefore:

$$\begin{aligned}\text{Prize for winning game } F &= (\text{wager for game } F)\times 2\\ &= (\$5 + E \text{ prize})\times 2\\ &= (\$5+10)\times 2\\ &= \$15\times 2\\ &= \$30\end{aligned}$$

Using the same logic and process, the prize for winning game G is $70.

Figure 2:
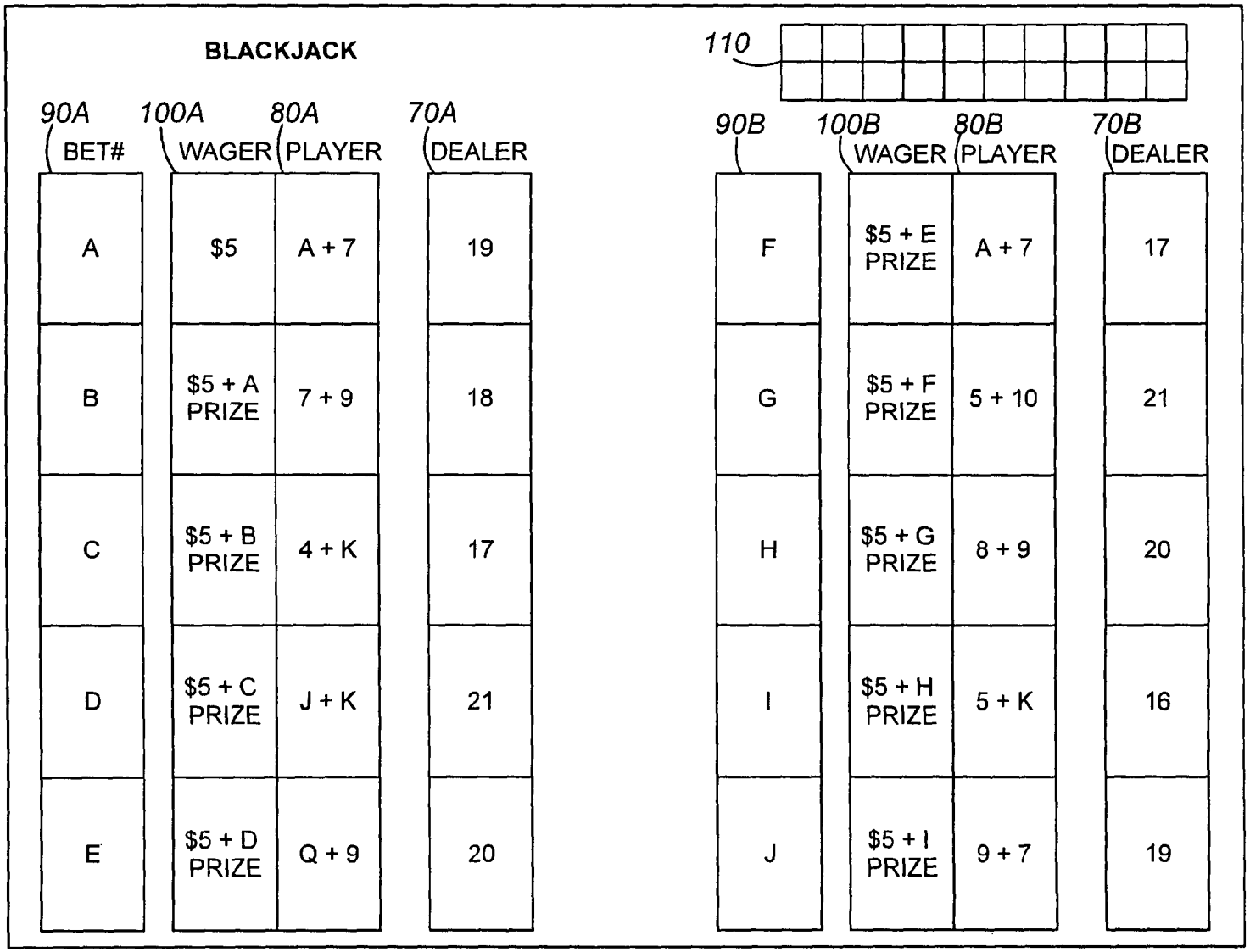
FIG. 2 illustrates an alternative instant win gaming ticket using a different game type to the instant gaming ticket illustrated in FIG. 1.

It should be noted that since the player did not win game H, the player's "streak" ends. The same rationale for awarding prizes apply to the game tickets illustrated in FIGS. 2 and 3 but applied to different types of games. As can be seen in FIG. 2, instead of playing a roulette type of game, the well-known card game of blackjack is played. Instead of trying to match the dealer's total in columns 70A, 70B, the player's total in columns 80A, 80B must be greater than the dealer's total. Again, the prize per game/row (the rows being denoted by a letter indicator in columns 90A, 90B) is determined by the wager column 100A, 100B. The win table 110 will show the amount the player can win for consecutive wins. As is accepted in most card games, an ace (represented by a letter A) is given a value of 11 and a "face" card (a king, queen, or jack as represented by the letters K, Q, and J respectively) is given a value of 10. As can be seen, the player only wins in hand F for the game ticket in FIG. 2. It should be noted that the player's total columns 80A, 80B and the dealer's columns 70A 70B are covered prior to the player's playing the game ticket.

Figure 3:
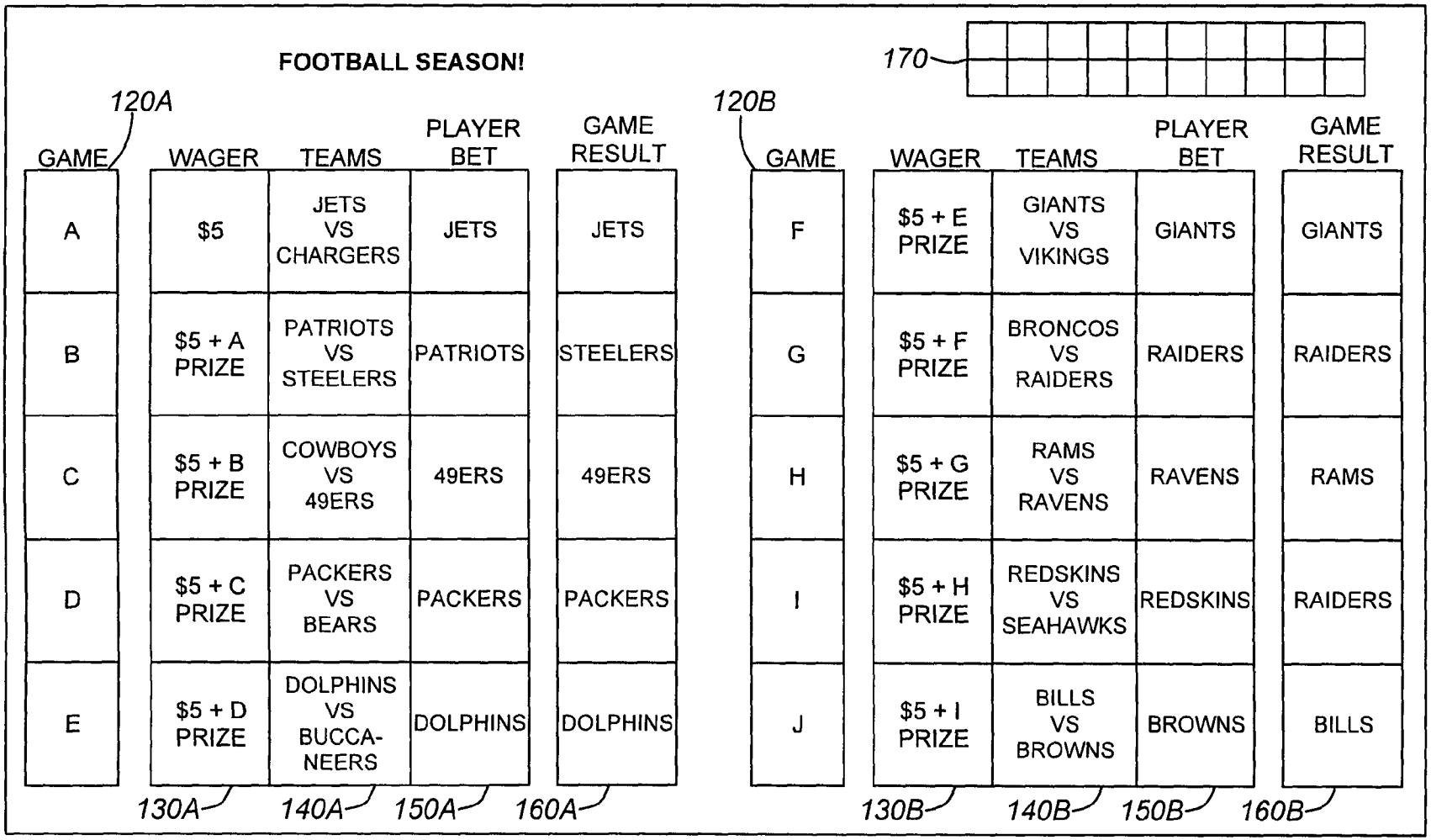
FIG. 3 illustrates yet a second alternative instant win gaming ticket using a third different game type to the instant gaming ticket illustrated in FIG. 1.

Referring to FIG. 3, instead of a card game or another game of chance, the results of a football season or a series of football games is simulated on the game ticket. The idea behind this type of a game ticket is that the player will wager on the outcome of a sporting event. For this game ticket, the sport is American football with the teams of the National Football League being represented on the ticket. Each row (denoted by a letter in columns 120A, 120B) denotes a single football game. Wager columns (columns 130A, 130B) denotes the wager on the game while team columns 140A, 140B note the teams playing the particular game for that particular row. The player's bet columns (columns 150A, 150B) denote the preselected teams that the player is "betting" to win. This column may or may not be covered prior to the playing of the game or purchase of the ticket. The game result columns 160A, 160B, on the other hand, are covered prior to the purchase of the game ticket. As can be seen, the game result columns 160A, 160B notes who won the particular football game.

Similar to the roulette game ticket in FIG. 1, the object of the game for the FIG. 3 ticket is for the player's bet to match the game result. Thus, if for a particular row, a player's preselected bet entry matches the entry for a game result, then the player has won the game. For the ticket in FIG. 3, it can be seen that the player has won games A, C, D, E, F, and G. The player has thus had a streak of 5 consecutive wins of games C to H. Using the same rationale as for the tickets illustrated in FIGS. 1 and 2, the longer a player's streak of consecutive wins, the larger is the ultimate wager per game and therefore, the larger the possible prize amount. This would be denoted in a win table 170.

In many instant win gaming tickets, the prize amount for winning a single game is double the amount wagered. Thus, if the amount wagered is $5 as in game A of the ticket in FIG. 3, winning that game results in a payout of $10 for the player. For the same ticket, the progressive nature of the wagering, with each wager dependent on the result of the immediately preceding game, results in an increasingly larger prize amount as the number of consecutive games won increases. Four consecutive games won results in cumulative winnings of $260 with the prize amount for the fourth game being $150. The amount wagered on the fourth hand was therefore $75. The given total does not include the $10 won in game A. To simplify matters, the individual amount won for the nth consecutive game won can be represented as in Equation 1:

$$W = x\sum_{i=1}^{n} y^{i} \tag{1}$$

with

W=amount won on the nth consecutive game won n=number of games won consecutively y=multiplier applied to wager if a game is won x=fixed starting wager per game For the game ticket in FIGS. 1,2, and 3, x=5 and y=2 if the wager is doubled for every win. If a player wins three times his wager if he wins a game, then y=3.

Using the same logic as above, the amount wagered on the nth game can be represented as in Equation 2 after (n−1) consecutive games won:

$$B = x\sum_{i=1}^{n} y^{i-1} \tag{2}$$

The variables in Equation 2 are as defined for Equation 1. The cumulative prize amount won after n consecutive games won can be represented as in Equation 3:

$$C = \sum_{a=0}^{n}\left(x\sum_{i=1}^{a} y^{i}\right) \tag{3}$$

where the variables as again as defined in Equation 1.

Using the above formulas, a sample win table (Table 1) can be as follows using y=2 and x=5:

TABLE 1

| Consecutive games won | 1 | 2 | 3 | 4 | 5 | 6 | 7 | 8 | 9 | 10 |
|---|---|---|---|---|---|---|---|---|---|---|
| Amount won on game ($) | 10 | 30 | 70 | 150 | 310 | 630 | 1270 | 2550 | 5110 | 10230 |
| Amount wagered ($) | 5 | 15 | 35 | 75 | 155 | 315 | 635 | 1275 | 2555 | 5115 |
| Cumulative prize ($) | 10 | 40 | 110 | 260 | 570 | 1200 | 2470 | 5020 | 10130 | 20360 |

As can be seen, the increase in the prize amounts between consecutively won games is geometric in pattern with the variable y denoting how fast or how slow the increase is in the winnings. Clearly, the higher the value for y, the larger the cumulative prize amounts. The increase in prize amounts between two consecutive prize amounts is a multiple of a previous increase. The prize amount for 4 consecutive games won is $150 while the prize amount for 3 consecutive games won is $70. The increase between these two prize amounts is $80—a multiple of the prize amount increase ($40) between prize amounts for two games won ($30) and three games won ($70). This fixed multiplier between increases prize amounts is due to the geometric progression between the increases.

Figure 4:
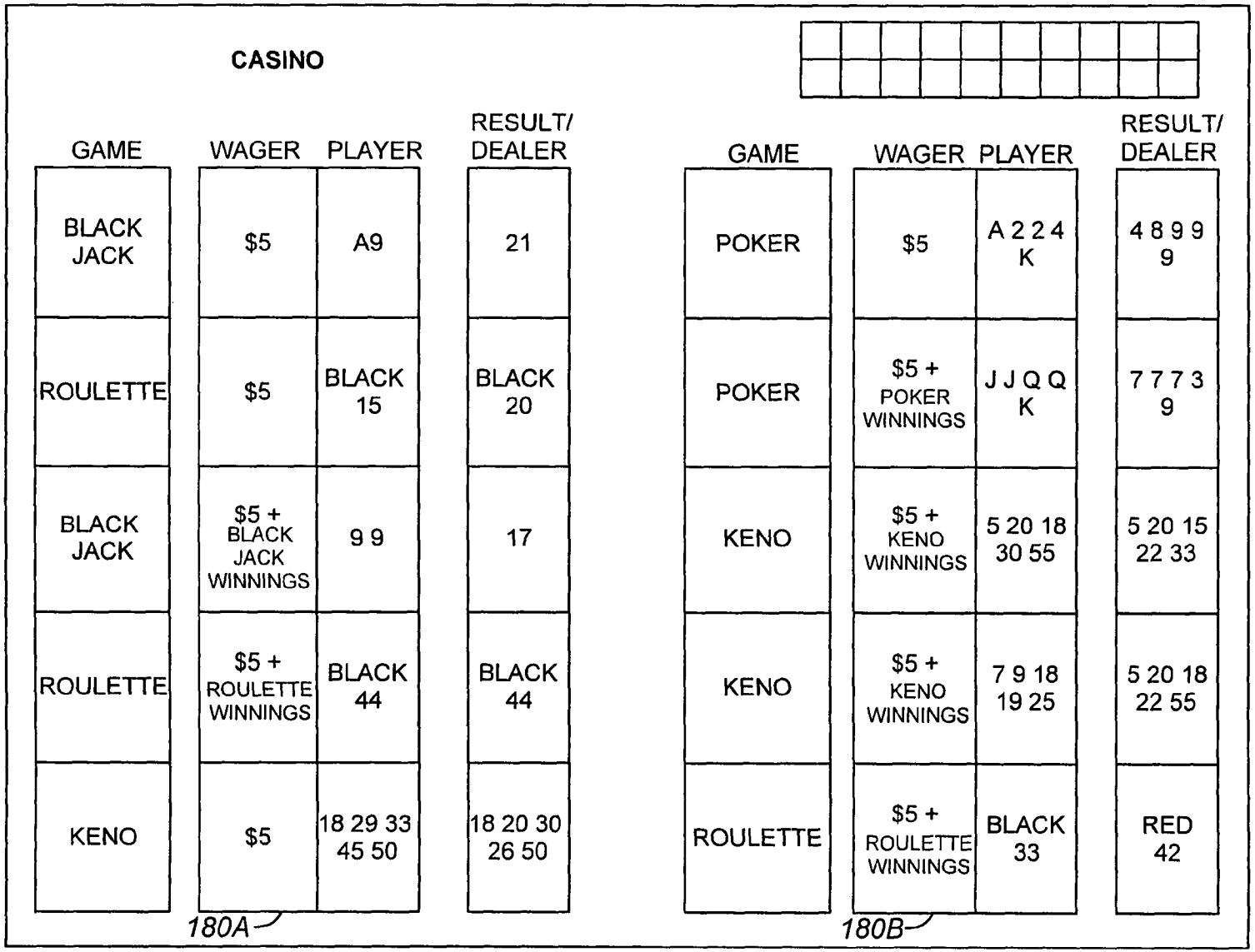
FIG. 4 illustrates a third alternative instant win gaming ticket simultaneously using multiple different game types.

While the game tickets in FIGS. 1,2, and 3, all use a single type of game for the individual games, this need not be the case for every gaming ticket. Referring to FIG. 4, an alternative type of gaming ticket is illustrated which also uses a progressive type method of awarding prizes. For this gaming ticket, the object is to simulate games that may be played in a casino. As such, four types of games, blackjack, roulette, keno, and poker are represented. For keno, the object is to match all five numbers that the dealer/house is given while conventional poker need not be explained here. From FIG. 4, the wager columns 180A, 180B denote the wagers for each game with wagers increasing for consecutive wins. However, the wagers increase only for consecutive games won of the same type. As such, consecutive poker games won increase the player's prize but consecutive dissimilar games won, such as blackjack and roulette, do not increase the player's prize. The amount a player may win still depends on whether a previous game was won or not but a caveat exists in that the previous game has to be of the same type as the game currently being played.

Figure 5:
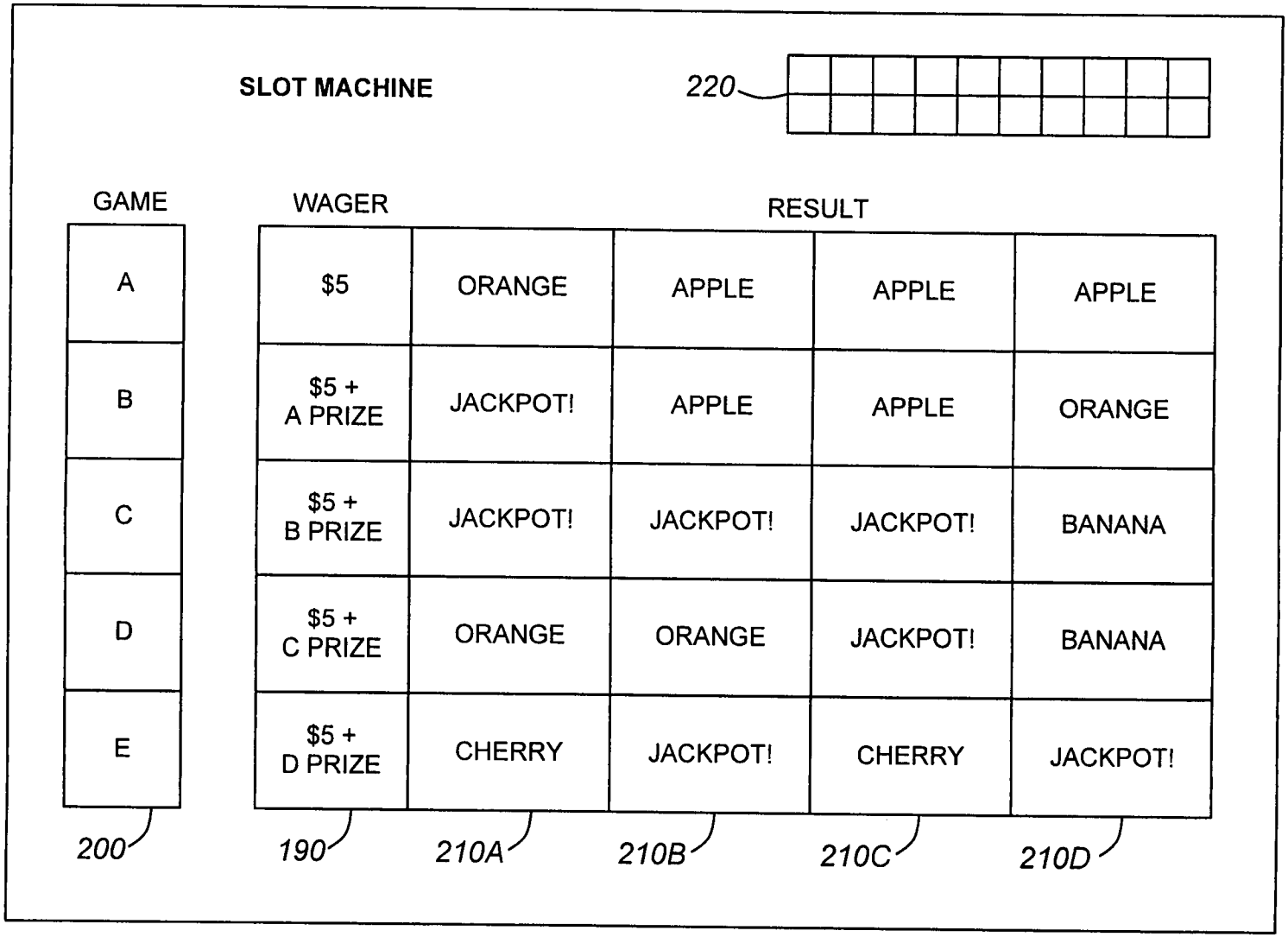
FIG. 5 illustrates a fourth alternative instant win gaming tickets using a modified prize amount allocation scheme.

Another alternative configuration for a gaming ticket is that illustrated in FIG. 5. The gaming ticket configuration in FIG. 5 simulates a slot machine. Column 190 documents the wagers for every slot game on the ticket while column 200 documents the gaming index letter. Columns 210A, 210B, 210C, 210D indicate the player's simulated slot machine results. The prize amount allocation for this game may be different from that of the gaming tickets illustrated in the previous figures. For the previous gaming tickets, each game was either completely won or lost. For slots, it is possible to have a partial win and be accorded a proportionate prize. The wining combinations for the slot machine may be documented in a win table 220, an example of which is reproduced in Table 2:

| Result: | 3 fruits of the same kind | 4 fruits of the same kind | Two Jackpots! | Three Jackpots! | Four Jackpots! |
|---|---|---|---|---|---|
| Prize: | Double the wager | Triple the wager | 1.5 times the wager | Triple the wager | Five times the wager |

Based on the above sample, win table and the ticket in FIG. 5, the player wins double his wager for game A and does not win anything for game B. For game C, the player wins triple his wager and, again, does not win for game D. For game E, the player wins one-and-a half times his wager. His total winnings for the ticket are therefore as follows:

| | |
|---|---|
| Game A | |
| Wager – $5 | Winnings – $5 × 2 = $10 |
| Game B | |
| Wager – $5 + $10 = $15 | Winnings – = 0 |
| Game C | |
| Wager – $5 | Winnings – $5 × 3 = $15 |
| Game D | |
| Wager – $15 + $5 | Winnings – 0 |
| Game E | |
| Wager – $5 | Winnings – $5 × 1.5 = $7.50 |
| Total Winnings = $10 + $15 + $7.50 = $32.50 | |

The above calculations assume that the player does not lose any of his previous winnings if he loses any games. Other, more complex win tables may be used and other, more complex formulas for penalizing the player for losing games may be used.

It should be noted that other games and configurations, such as other card games like pai gow, poker, high-low, and others, and numbers games may be used for the games in the gaming tickets. Also, other sporting events, such as basketball games, soccer games, and hockey games may be simulated in place of the football events illustrated and explained above. Furthermore, numbers games, some of which may be similar to keno, and other wagering games such as slots, can also be used for the gaming tickets.

The above invention should provide increased enjoyment to instant wins game ticket players. As further inducement to purchase and play these games, one possible caveat to the wagering on the ticket is that players do not lose any prizes they win regardless of any wagers they make in subsequent games. As an example, using the game tickets in FIGS. 1, 2, and 3, if a player wins games A, B, and C and, and because of the progressive nature of the wagering, the wager for game D is the amount won for game C, if the player loses game D, he does not lose his winnings for game C. The only drawback for the player is that his wager for game E is not very large since his winnings for game D is zero.

An alternative to the above scheme is to have a feature in the gaming ticket such that a player loses some or all of his previous winnings if he loses a game. Thus, the player must, before playing a game, decide whether to continue playing or to redeem any winnings he may already have.

A person understanding this invention may now conceive of alternative structures and embodiments or variations of the above all of which are intended to fall within the scope of the invention as defined in the claims that follow.

What is claimed is:

1. A method of facilitating the play of an instant win game, comprising:

providing a player instant win games on a machine, the instant win games including concealed game play information for a plurality of games, the plurality of games having a sequential order, each of the plurality of games having a respective concealed result, each result having a respective specific prize, after revealing the result by the player, providing a final prize associated with the game;

calculating a final prize for the game by a processor on the machine; and awarding the final prize to the player, the final prize having a value reflecting an increase that is based at least in part on winning of consecutive games in the plurality of games.

2. The method of claim 1, further comprising:

Increasing prizes awarded after every winning game on the instant win gaming ticket based on a number of consecutive games won, wherein in any sequence of a first, second, and third successive winning games on the instant win gaming ticket, the increase in prize amounts between the second and third games is a multiple of the sum of a prize amount for the first game and the prize amount for the second game.

3. The method of claim 1, wherein the sequential order is indicated on the machine.

4. The method of claim 1, wherein the number of games played is equal to the total number of games provided in the plurality of games.

5. The method of claim 1, wherein the number of games played is less than the total number of games provided in the plurality of games.

6. The method of claim 1, wherein the specific prize for any particular game with a winning result, after the first game in the plurality of games, has a value determined by a multiplier applied to the sum of a first value plus the specific prize which was awarded to the game immediately preceding proceeding the particular game.

7. The method of claim 6, wherein the first value is set before the particular game is played.

8. The method of claim 7, wherein the particular game has a plurality of possible results and the first value is determined at least in part by the result of the particular game.

9. The method of claim 8, wherein the value of each of the plurality of possible results is listed on a win table.

10. The method of claim 1, wherein a majority of the plurality of games all have the same format.

11. The method of claim 1, wherein at least one of the plurality of games simulates a sporting event.

12. The method of claim 1, wherein at least one of the plurality of games simulates a casino wagering game.

13. The method of claim 12, wherein the at least one game includes a card based game.

14. The method of claim 13, wherein the game is blackjack.

15. The method of claim 1, wherein at least one of the plurality of games is a different format than at least one other of the plurality of games.

16. The method of claim 1, further comprising:

responsive to a particular game having a losing result, forfeiting at least a portion of specific prizes previously awarded in the instant win lottery.

17. A method according to claim 1, further comprising:

retaining any specific prizes previously awarded even if a game does not have a win result.

18. The method of claim 1, wherein the final prize depends, at least in part, on the number of sequentially ordered games, including the last game in the sequential order of the plurality of games, that consecutively have a winning outcome.

19. The method of claim 1, further comprising:

changing specific prizes awarded after every winning game played on the games based on a number of games won, wherein an increase in specific prizes is determined based on a number of games won, wherein specific prizes awarded after every game played is based on a number of consecutive games won.

20. A method of facilitating the play of an instant win game, the method comprising:

providing an instant win game to a player on a machine, the instant win game concealing concealed game play information for a plurality of sequentially ordered games, each game having an associated result, and each game also having a respectively associated specific prize which depends on the result of that game, wherein revealing the concealing game play information reveals the result of at least one of the plurality of the sequentially ordered games;

calculating a final prize for the game by a processor on the machine; and after revealing the concealing game play information by the player providing a prize whose value reflects an increase for winning consecutive games.

21. The method of claim 20, wherein the specific prizes associated with games having a losing result have zero value.

22. The method of claim 20, wherein the value of the specific prize is indicated by the game play information associated with the corresponding game.

23. The method of claim 20, wherein the result is the specific prize.

24. The method of claim 20, wherein the value of the specific prize for each game is indicated by the game play information for that game.

25. The method of claim 20, wherein the one of the specific prizes is the specific prize for the last game.

26. The method of claim 20, further comprising:

paying the player the value of the prize whose value is indicated by the one of the specific prizes, the value of the one of the specific prizes depending at least in part on some of the other specific prizes.

27. The method of claim 20, wherein the one of the specific prizes is the specific prize whose value is greater than or equal to any other specific prize.

* * * * *